US006536168B1

(12) United States Patent
Cugini et al.

(10) Patent No.: US 6,536,168 B1
(45) Date of Patent: Mar. 25, 2003

(54) APPARATUS AND METHODS FOR MOLDABLE AND CUSTOMIZABLE STRUCTURES

(75) Inventors: Mario Alfredo Cugini, Vista, CA (US); Ralph Lynn Giusti, Vista, CA (US)

(73) Assignee: San Donato LLC, Vista, CA (US)

( * ) Notice: Subject to any disclaimer, the term of this patent is extended or adjusted under 35 U.S.C. 154(b) by 0 days.

(21) Appl. No.: 09/596,290

(22) Filed: Jun. 15, 2000

(51) Int. Cl.[7] ..... E04C 2/52
(52) U.S. Cl. ..... 52/220.2; 52/220.5; 52/220.3
(58) Field of Search ..... 52/220.1, 220.2, 52/220.3, 220.5, 220.8, 250, 505, 580, 581, 568, 606, 607

(56) References Cited

U.S. PATENT DOCUMENTS 2,010,294 A * 8/1935 Dovell ..... 52/211
3,529,389 A * 9/1970 Wilkens ..... 52/211
4,276,730 A * 7/1981 Lewis ..... 52/221
4,616,459 A * 10/1986 Shubow ..... 52/309.12
4,896,469 A * 1/1990 Wright ..... 52/221
5,411,782 A * 5/1995 Jarvis et al. ..... 428/57
6,233,891 B1 * 5/2001 DeCosse ..... 52/309.12

* cited by examiner

*Primary Examiner*—Carl D. Friedman
*Assistant Examiner*—Naoko Slack
(74) *Attorney, Agent, or Firm*—Calif Tervo

(57) ABSTRACT

Improved apparatus and methods for making, assembling and constructing a standardized wall and floor or ceiling panel made of a cementitious material, or similar material, for walls, ceilings, roofs and foundations. An embodiment of the invention implements both pre-cast and cast in place steel reinforced systems of interconnected panels to form a monolithic building structure. A panel unit is formed with longitudinal cavities and interconnected transverse cavities and when used in a structural system, a panel is connected to adjoining panels using an alignment plug. The interconnected panels thus provide passages or ducts for piping, wires and other conduit to run uninterrupted from panel to panel, wall to wall and wall to floor, which can be accessed through a closable access opening. A continuity alignment pipe or a shear transfer bar may be used in the structure. The panel may be customized by providing a door or window opening for applications calling for such embodiments.

3 Claims, 8 Drawing Sheets

APPARATUS AND METHODS FOR MOLDABLE AND CUSTOMIZABLE STRUCTURES

BACKGROUND OF THE INVENTION

The field of the invention is apparatus and methods for making, assembling and constructing structures such as dwellings or the like. It is expected that the 21$^{st}$ century will see a severe shortage of housing, especially low income housing. This shortage is expected to be even more acute for those living in poverty conditions and for persons in need of homeless shelters in urban areas of the industrialized world. There is a need for smaller and more affordable housing, including housing for needy persons seeking shelter or refuge. The positive effect adequate shelter has on a human being is obvious.

There is also a need for housing that is less expensive and longer lasting. Most U.S. dwellings are made of wood frame construction. This includes wood beams, wood columns and plywood that is nailed, strapped and bolted together using a series of studs and plates. Standard wood frame construction has many problems and consequently, has spawned a number of industries to cope with pest control, fire control, sound control and energy control, among others. The net effect of this is to increase the cost of home ownership, including homeowners' insurance. These costs can be viewed as wasted funds that could be redirected into income producing efforts. It is estimated that U.S. families spend a tremendous amount of money on this type of home protection compared to their counterparts elsewhere.

Insulated concrete forms, or "ICF", uses foam blocks which are filled with concrete and steel. This process works on walls, not on ceilings, and most importantly, it requires carving passages into the foam material for conduits and the like. Another construction material is pre-cast concrete, which has been in existence for a long time. Some pre-cast concrete designs allow for grout or pipe openings however, no system is known to exist which is designed to encompass the requirements of a dwelling or similar structure.

Cast-in-place systems are also used. This process is the most common method of construction in Europe and South America. In this process, all foundations, floors, beams and ceilings are made of poured in place concrete. Walls are added later by using bricks or blocks which are later finished with plaster. The "tilt-up" method of construction casts concrete walls in place using embedded attachments for wooden or metal roofs. When cured, the walls are tilted upward into place. This method is prevalent in industrial building applications.

Another well known method uses what is known as hollow core panels having a series of parallel cells. These conventional panels are mostly used as floor planks in high rise buildings. The conventional process to manufacture these uses a long bed, 500 feet or longer typically, which looks like an airport runway. The conventional hollow core panels are cast on the long bed with the equipment, materials and personnel moving along the bed as the hollow core panels are formed in a continuous span. The continuous span of hollow core panels never moves until it is cut up and loaded for transport to the installation site. This procedure includes a significant amount of down time, due to time lost to transportation of personnel and materials. Cavities conventionally have been created in structural panels in a variety of ways, including using inflatable tubes or augers. All these techniques have met with limited success.

SUMMARY OF THE INVENTION

The present invention is a solution to many of the problems associated with conventional apparatus and systems. In one embodiment, the invention combines pre-cast systems with cast-in-place systems creating a structure that is stronger, longer lasting, non-flammable and extremely resistant to bio-degradation. The invention creates both access to, and interconnection of, electrical lines and plumbing throughout an entire structure. It also eliminates most of the drilling necessary by skilled tradesmen, such as electrical work and plumbing work. It provides access to electrical and plumbing circuits and easy access to such systems for repair, maintenance and upgrading. The inventive panel can be made in a production line, allowing personnel, equipment and materials to remain in a specific location while the panel travels through the manufacturing process.

Thus, it is an object of the present invention to provide improved apparatus and methods for making a useful panel made of a cementitious material, or other material, for walls, ceilings, roofs and foundations for dwellings or the like. It is an object of the present invention to provide improved methods of construction using panels of the type shown and described herein.

It is an object of the invention to utilize a novel combination of pre-cast and cast-in-place concrete with a series of interconnected reinforced posts and beams to provide a stronger structure.

It is an object of the invention to provide a monolithic structure so that in the case of terrain slippage, the structure would move as a complete unit, minimizing or eliminating breakage into pieces.

It is an object of the invention to provide permanent access to wiring and pipes through a removable plate on the wall of a structure.

It is an object of the invention to provide a novel system of permanent passages in a structure to permit the placement of, and later access to, plumbing, electrical, telephone, television, heating ducts and other circuits and services without the need to tear down walls or drill conduit passage holes.

It is an object of the invention to provide methods to access plumbing and electrical circuits in a structure to construct, maintain or upgrade them.

It is an object of the invention to provide a method for transferring shear forces across ceiling and floors in a structure to create a diaphragm.

It is an object of the invention to provide a novel structure for dwellings and the like that is non-flammable, not attacked by pests, is bullet proof and flood resistant.

Other and further objects will appear to those skilled in the art from the specification and drawings.

DETAILED DESCRIPTION OF THE PREFERRED EMBODIMENTS

Figure 1:
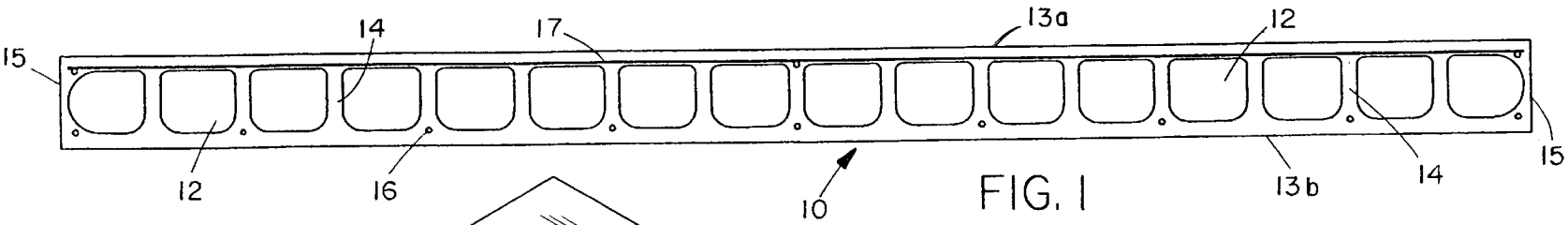
FIG. 1 is an end view of a preferred embodiment of the present invention showing a wall panel.
Figure 2:
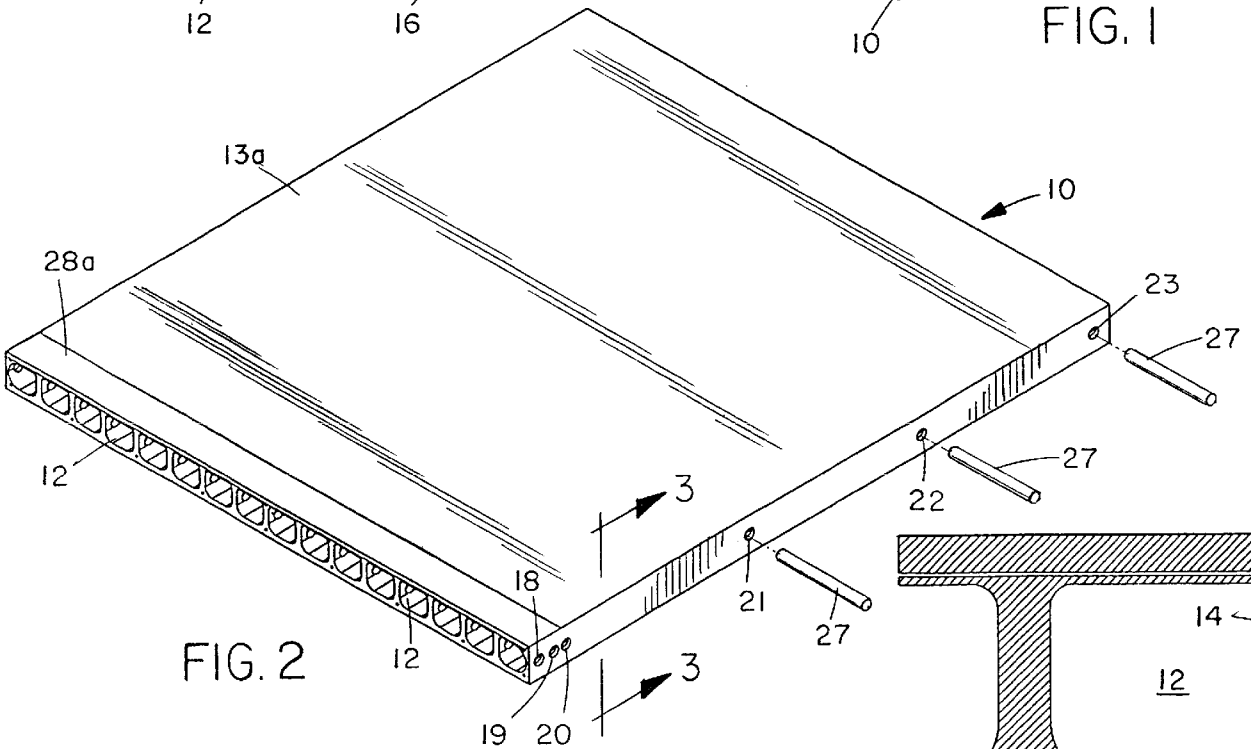
FIG. 2 is a perspective view of a wall panel.
Figure 3:
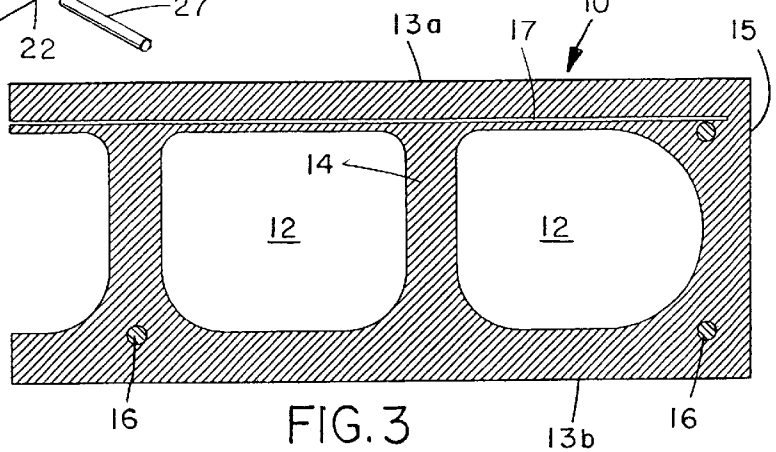
FIG. 3 is an enlarged sectional view taken on line 3—3 of FIG. 2.

In a preferred embodiment, FIGS. 1 and 2 show the novel panel 10 in a wall configuration. The panel 10 is preferably made of concrete, a cementitious material or other materials known to skilled persons to have similar properties. The concrete or other material is preferably reinforced with steel reinforcing bars or fibers with similar properties. The panels 10 can be manufactured in various widths, heights and thicknesses as requirements may dictate and the panel 10 can be custom molded in place, or made remotely and transported to an installation site.

Figure 15:
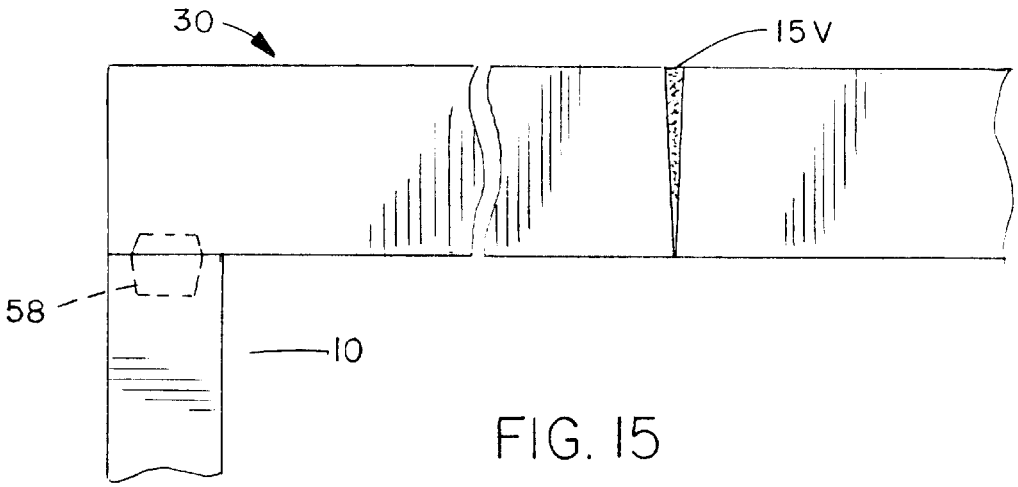
FIG. 15 shows a typical panel joint using an alignment plug.

Preferably, the wall panel 10 has a plurality of cell cavities 12 as shown in FIG. 1. The cell cavities 12, which preferably span the longitudinal length of the panel 10, will be vertically oriented when the panel 10 is used as a wall in a dwelling or other structure. The cell cavities 12 are surrounded by top 13*a*, bottom 13*b* and ribs 14 as shown in FIG. 1, which are designed to sustain the applied loads. The concrete material making up the panel 10 is preferably reinforced with reinforcing steel bars 16 and wire mesh 17 to strengthen the panel 10 and allow it to sustain the different loads and forces that the structure may be subjected to. In the preferred embodiment, the panel 10 is made with end ribs 15 angled slightly, creating v-groove 15v as illustrated in FIG. 15 for demonstrative purposes.

The preferred embodiment includes transverse interconnection openings 18, 19, 20, 21, 22 and 23 as labeled and shown in FIG. 2. In this embodiment, the openings 19–23 provide transverse pathways between cell cavities 12 and as can be appreciated by skilled persons, providing pathways for conduit used in dwellings and other structures. In this embodiment, interconnection openings 18 and 19 shown in FIG. 2 may be designated for plumbing pipes, openings 20 and 21 for electrical circuit wiring, opening 22 for alignment of and access to door and window openings and opening 23 for general purposes. Continuity alignment pipe 27 is preferably used to link wall panels 10 together and maintain conduit access across cell cavities 12 that may have to be filled with concrete or other cementitious material. In the preferred embodiment, the panel 10 includes baseboard access 28 (shown in FIGS. 7, 8 and 11) with removable cover 28*a* permitting access to interconnection openings 18, 19 and 20 shown in FIG. 2. Access to interconnection opening 23 is facilitated too in the case of a lower wall panel 10.

Figure 4:
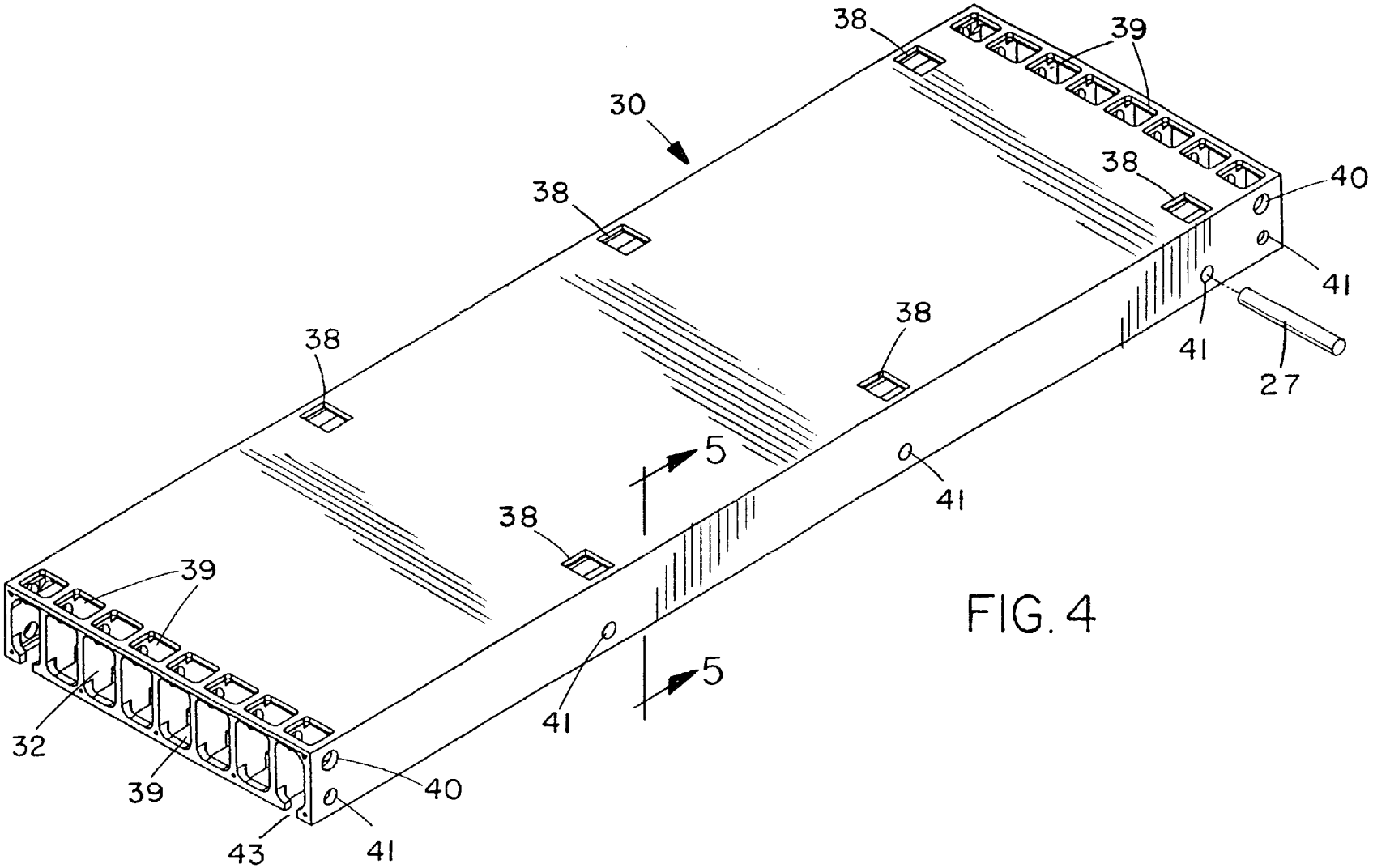
FIG. 4 is a perspective view of a ceiling panel.

In a preferred embodiment, FIG. 4 shows a floor/ceiling panel 30. This panel 30 is preferably made of concrete, a cementitious material or other materials known to skilled persons to have similar properties. The concrete or other material is preferably reinforced with steel reinforcing bars or fibers with similar properties. The panels 30 can be manufactured in various widths, heights and thicknesses as requirements may dictate and to accommodate longer spans. The panels 30 can also be custom molded in place or made at a remote manufacturing facility and transported to an installation site.

Figure 6:
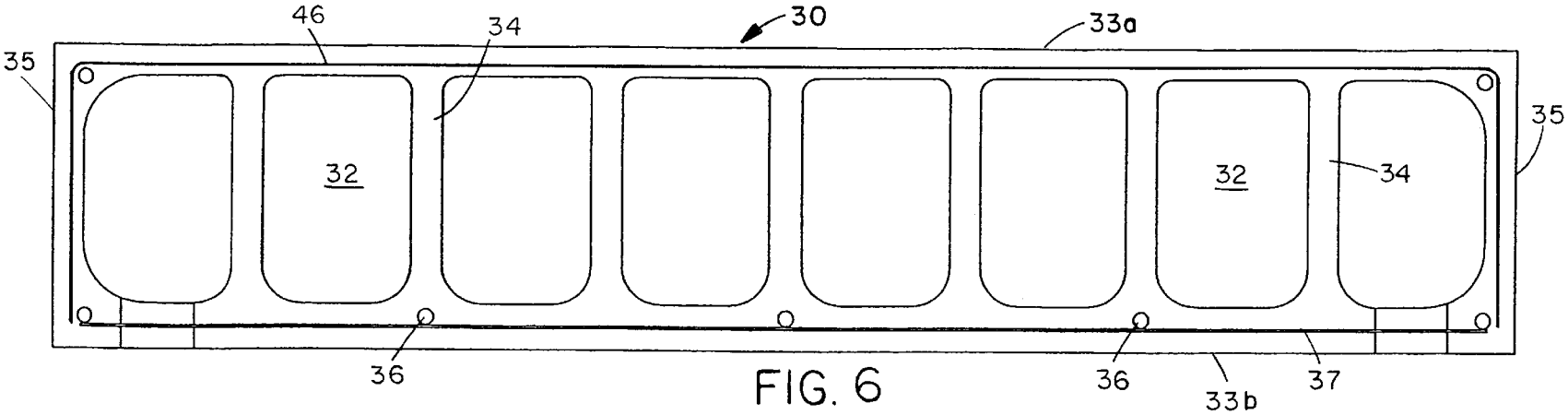
FIG. 6 is an end view of the ceiling panel.
Figure 5:
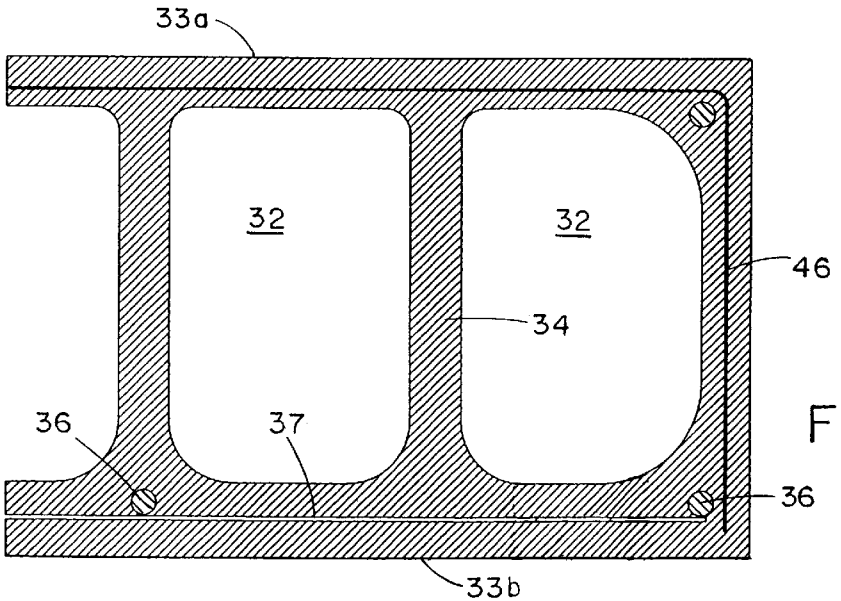
FIG. 5 is an enlarged sectional view taken on line 5—5 of FIG. 4.

This floor/ceiling panel 30 has cell cavities 32 as shown in FIGS. 4, 5 and 6 forming a hollow core panel. The cell cavities 32 will vary in height since thicker panels 30 may be required and are within the scope of the invention. Preferably, the cell cavities 32 span the longitudinal length of the panel 30 as shown in FIG. 4. In a preferred embodiment, the width of cell cavities 32 is the same as the width of cell cavities 12 (for wall panel 10) to allow for proper alignment of conduit that spans between a wall panel 10 and floor/ceiling panel 30. The cell cavities 32 are surrounded by faces 33*a*, 33*b* and ribs 34 which are designed to sustain the applied loads. The concrete material of the panel 30 is reinforced with reinforcing steel bars 36 and wire mesh 37 as is known to skilled persons. Additional reinforcing steel bars 46 for shear strengthening is preferably placed as shown in FIGS. 5 and 6. The panel 30 is preferably made with end ribs 35 angled slightly, creating a v-groove 35v as demonstrated in FIG. 9.

Figure 9:
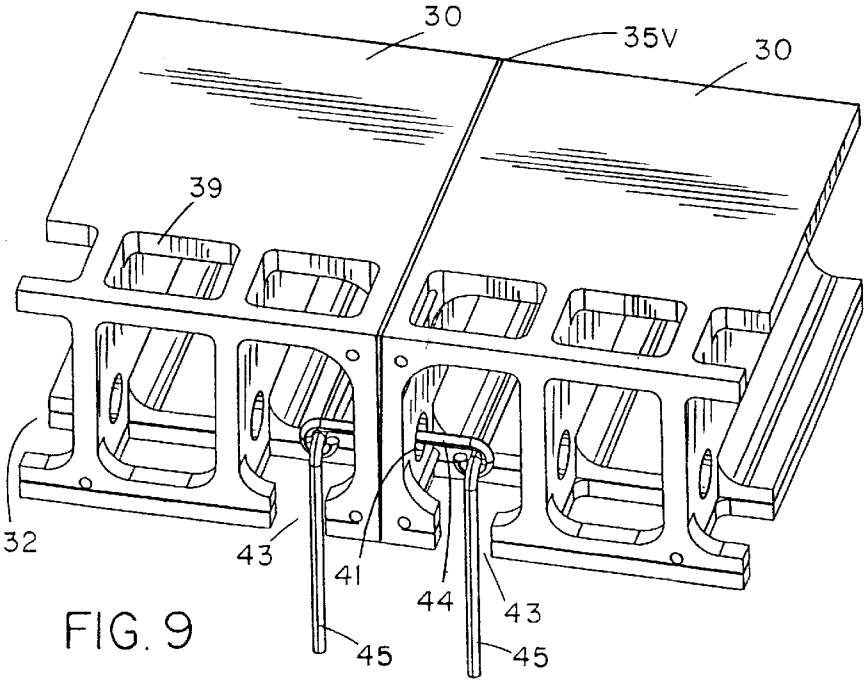
FIG. 9 is a perspective view showing the junction of two side-by-side ceiling panels and a shear transfer bar.

The preferred embodiment includes transverse interconnection openings 40 and 41 as shown in FIG. 4 to provide transverse pathways running between cell cavities 32. Interconnection openings 40 are preferably designated for general purpose and act in a similar fashion as transverse openings 18–23 described previously. Continuity alignment pipe 27 shown in FIG. 2 is also used to link floor/ceiling panels 30 together in a similar fashion as for wall panels 10, using interconnection openings 40, and maintain conduit access across cell cavities 32 that may have to be filled with concrete or other cementitious material. Top/bottom access hole 39 allows for the continuation of cell cavities 12 from lower wall panel 10, through floor/ceiling panel 30 and to the next upper wall panel 10. Preferably, the panel 30 is provided with openings 38 as shown in FIG. 4 so that appropriate shear transfer reinforcing and concrete can be inserted into the cell cavities 32 to create a structural link between adjacent floor/ceiling panels 30. As shown in FIG. 9, shear transfer bar 44 is preferably used to hook together steel reinforcing bars 45 continuing from wall panel 10 into floor/ceiling panel 30. The shear transfer bar 44 lessens or eliminates the need to spot tie or weld shear transfer bar 44 to steel reinforcing bars 45. Preferably, the floor/ceiling panel 30 includes a rebar passage 43 as shown in FIGS. 4 and 9 to facilitate placement of the reinforcing bars 45. As shown in FIG. 9, side hole 41 permits placement of the shear transfer bar 44 between panels 30 to form an integral structural unit.

Figure 7:
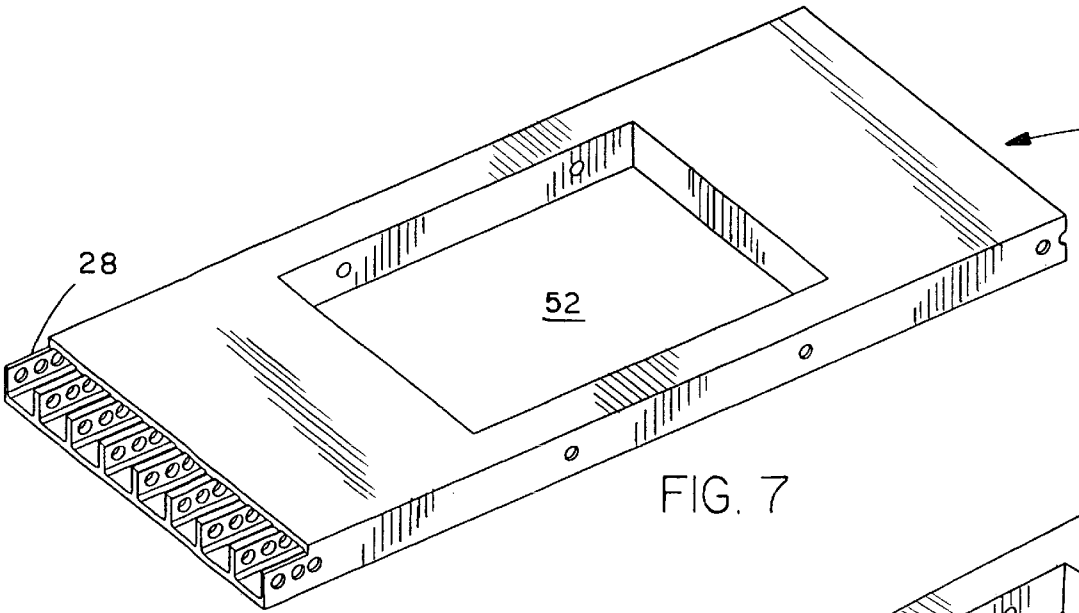
FIG. 7 is a perspective view of a wall panel with a window opening.
Figure 8:
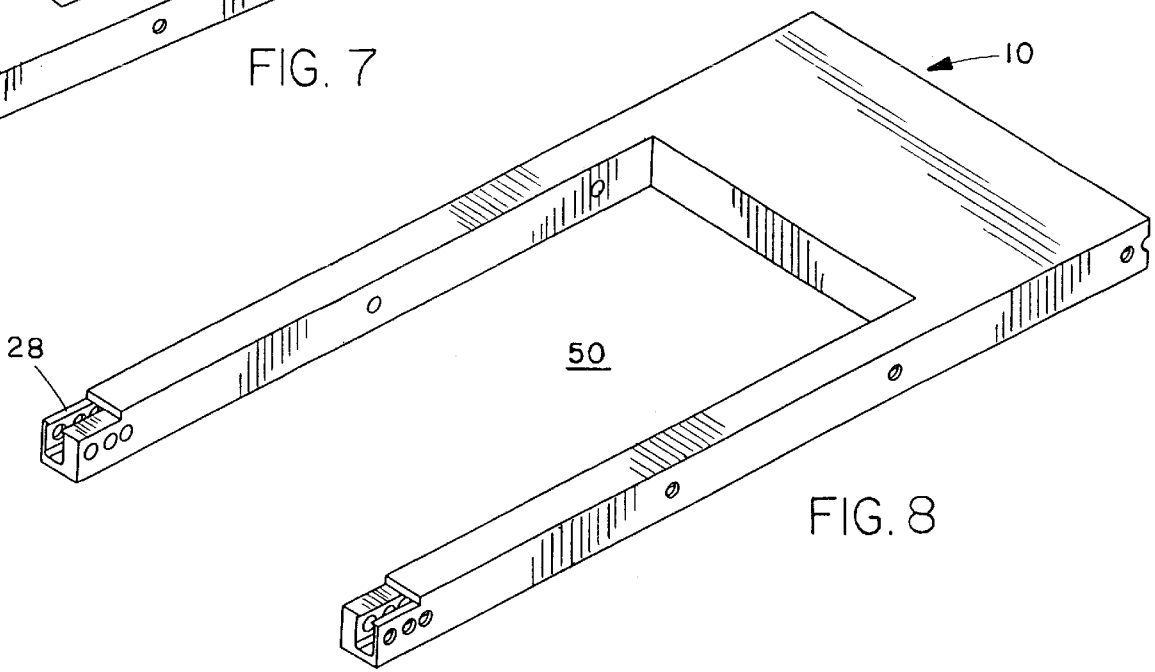
FIG. 8 is a perspective view of a wall panel with a door opening.

A preferred embodiment of a wall panel 10 with door opening 50 is shown in FIG. 8. The wall panel 10 can be molded in place or manufactured at a manufacturing plant and then transported to a construction site for installation. Wall panels 10 can be manufactured with different sized door openings 50. FIG. 7 shows a preferred embodiment of wall panel 10 with window opening 52. The window opening 52 can also be manufactured in different sizes and shapes as requested by the builder or building developer.

Figure 10:
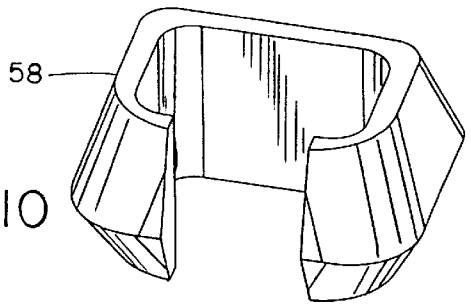
FIG. 10 is a perspective view of an alignment plug for aligning joined panels.
Figure 17:
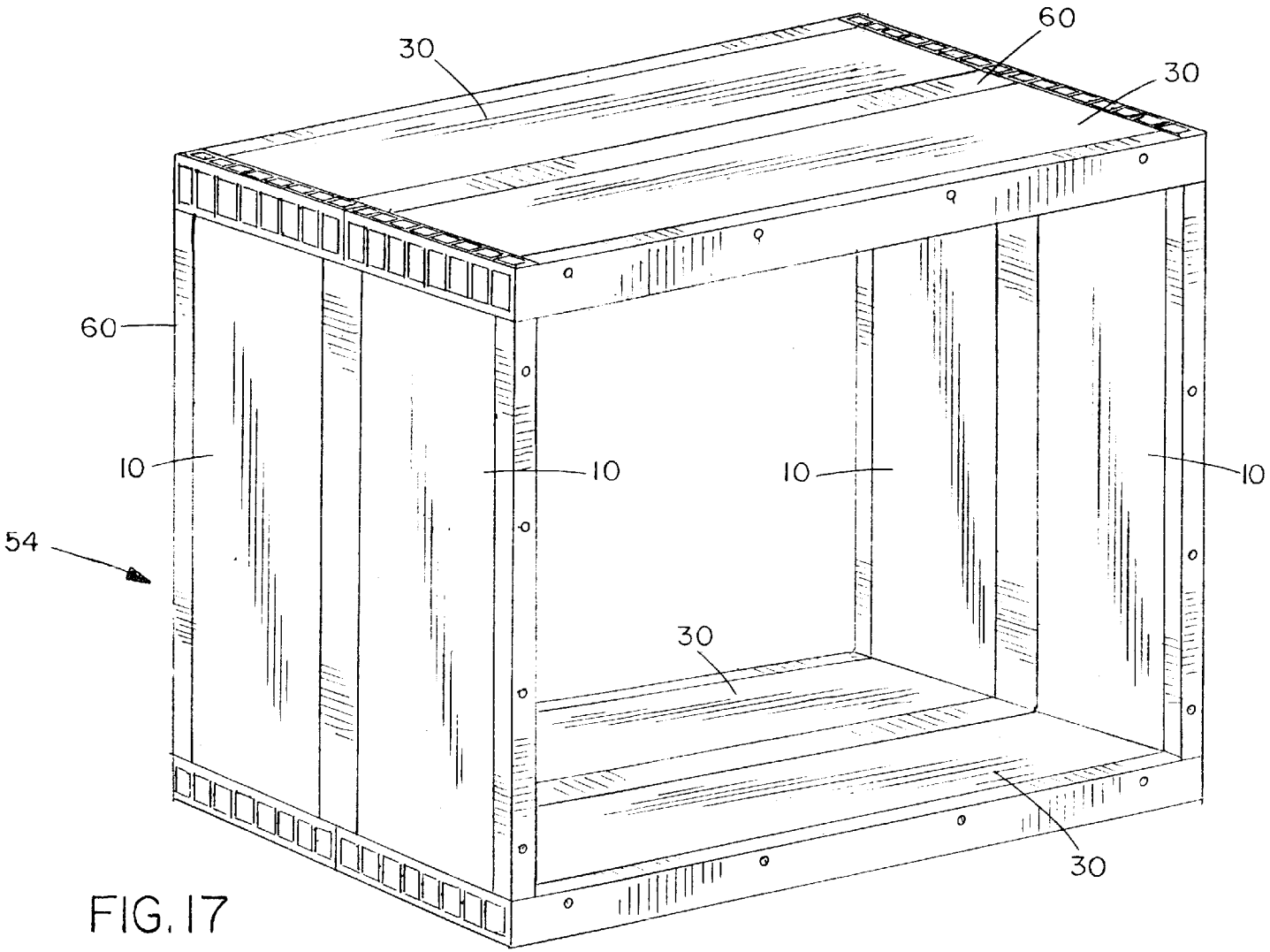
FIG. 17 is a perspective view illustrating a cast-in-place system of interconnected wall panels and ceiling panels in a monolithic structural embodiment of the invention.

FIG. 17 shows a monolithic structural system 54 assembled from the wall panels 10 and floor/ceiling panels 30. In a preferred assembly method, floor/ceiling panels 30 are used as a floor and the wall panels 10 are placed in a vertical orientation rising from floor panels 30 with another set of floor/ceiling panels 30 forming a ceiling or base for the next higher floor. Preferably, alignment plug 58 shown in FIG. 10 is utilized. In this embodiment, one end of the alignment plug 58 is sized to snugly fit onto the opening of cell cavity 12 of a wall panel 10 and the opposite end of the alignment plug 58 fits snugly onto the top/bottom access hole 39 of the floor/ceiling panel 30 as shown in FIG. 15. This allows the wall panel 10 to remain aligned with the floor/ceiling panels 30 as shown in FIG. 15, by aligning the cell cavities 12 at the lower end of wall panel 10 with the top/bottom access holes 39 of the floor panel 30 and for the next higher floor, aligning the cell cavities 12 at the upper end of wall panel 10 with the holes 39 of the ceiling panel 30. The alignment plug 58 can be made of a solid material such as concrete and left in the structure after competed as in FIG. 15, or alignment plug 58 can be made of conventional pliant materials so it can be folded and then removed through the baseboard access 28. Wall panels 10 are placed next to each other as shown in FIG. 17 and alignment maintained by the use of continuity alignment pipes 27 shown in FIG. 2, to link wall panels 10. Preferably, corner wall 10 connections use modified continuity alignment pipes 27 which are bent in a 90 degree configuration known to skilled persons, to allow passage of pipes and wiring around corners.

In the preferred method, once walls 10 have been assembled on one level, say the first floor of a dwelling, alignment plugs 58 are placed on top of the walls in the manner described above, to facilitate placement of the ceiling panels 30. Thereafter, reinforcing steel 45 is placed as needed and preferably hooked together using shear transfer bars 44 where appropriate. End cell cavities 12 and 32 are then filled with a cementitious material, such as concrete creating a continuous post/beam/post configuration as shown in FIG. 17. The assembled structure 54 in FIG. 17 shows one embodiment of this configuration with the filled cavities 60 shown interconnecting the panels 10 and 30.

Figure 11:
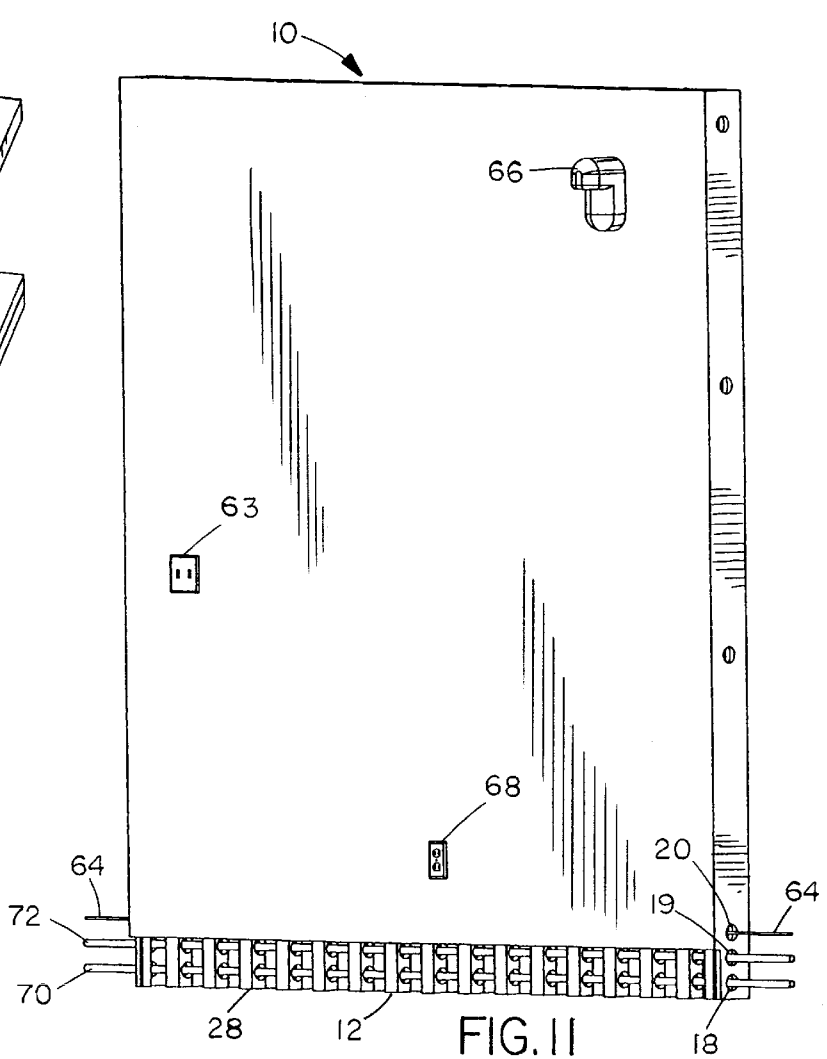
FIG. 11 is a perspective view of a wall panel with typical plumbing, wiring and fixtures installed.

In FIG. 11 a typical wall panel 10 is shown with utilities in place including parts of the electrical circuit including light switch 63 and electrical wiring 64 to control light fixture 66. The wiring 64 passes through the transverse interconnection opening 20 and cell cavities 12. Another circuit passes wiring 64 through opening 20, connects to AC plug 68 though cell cavity 12 and continues out of the panel 10 though opening 20 at the opposite end of panel 10 to an AC circuit of an adjacent wall panel 10. This demonstrates one advantage of both transverse and longitudinal conduit passages. FIG. 11 also shows plumbing pipes 70 and 72 running through the wall panel 10 through openings 18 and 19 respectively.

Figure 13:
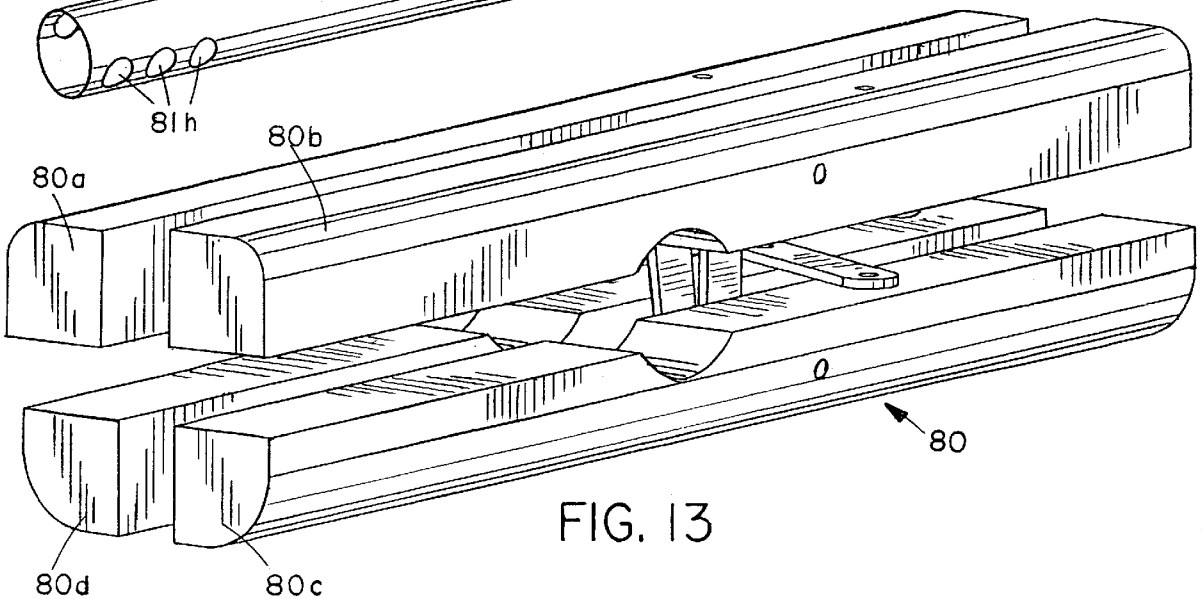
FIG. 13 is a perspective view of an expander unit.
Figure 14:
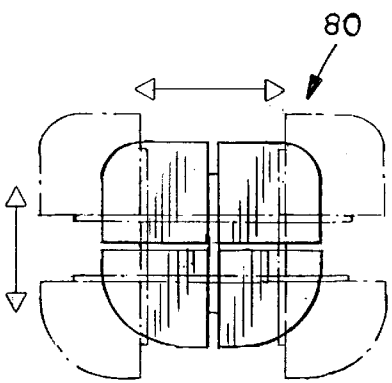
FIG. 14 is an end view of the expander unit, showing the collapsed and expanded positions.
Figure 16:
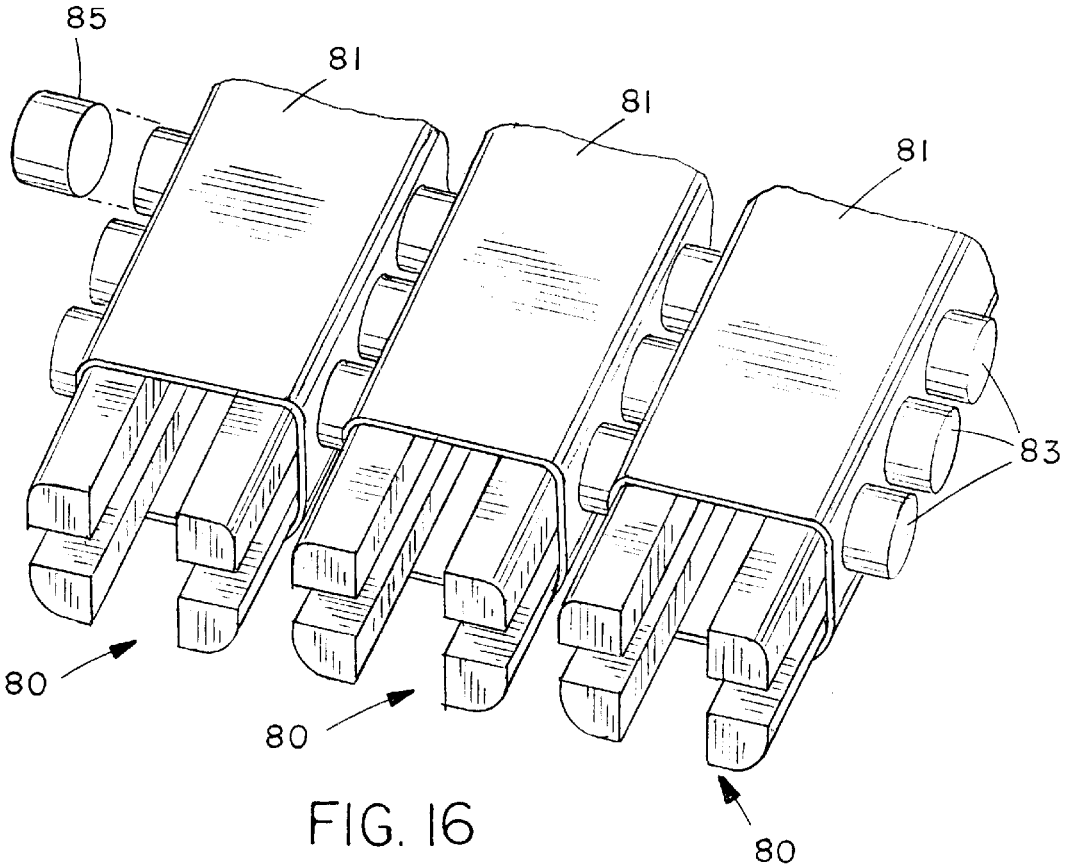
FIG. 16 is a perspective view of the ends of multiple interconnected liner tubes in an expanded configuration.

FIG. 16 illustrates a preferred method of making a panel through the use of an expander unit 80 and liner 81. As shown in FIG. 13, expander unit 80 is preferably comprised of four members 80*a–d* linked together as shown in FIGS. 13–14. Members 80*a–d* can be spread apart or brought closer together manually or by pneumatically operated or electrically operated devices known to skilled persons. As shown in FIG. 16, liner 81 is placed on the collapsible structure 80 to form the cavities. Once the concrete or similar material has been poured and adequately set or cured, the expander unit 80 is collapsed and removed. The liner 81 is then preferably removed a few hours later.

Figure 12:
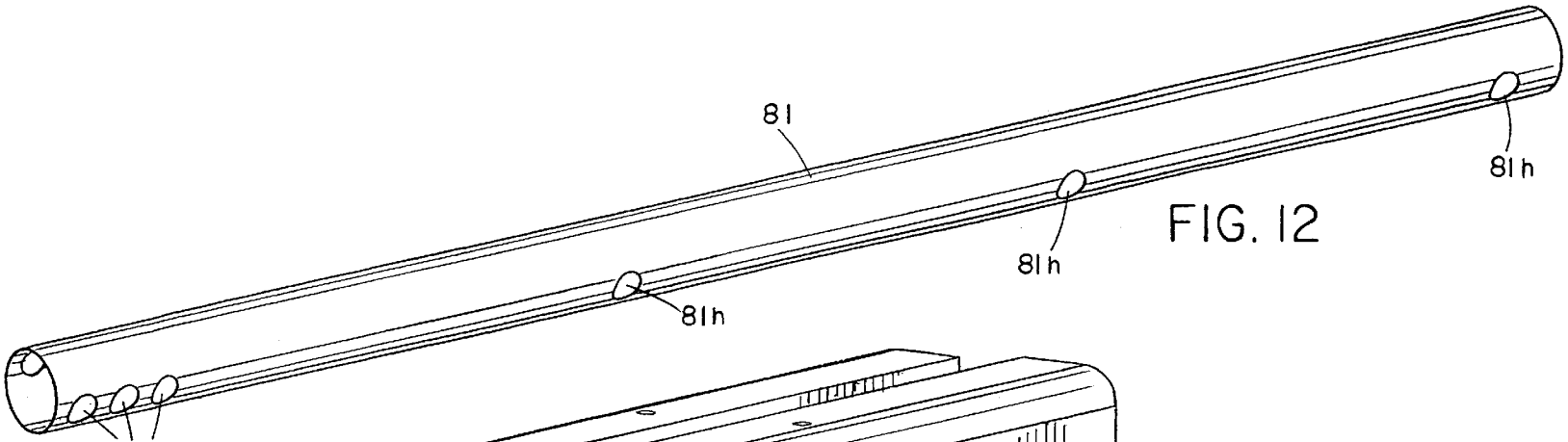
FIG. 12 is a perspective view of an expandable liner tube.

Another preferred method is shown in FIG. 16, where cross-sectional bar 83 is inserted in each location where openings are required. This cross-sectional bars 83 passes through holes 81*h* in liner 81, shown in FIG. 12, and through passages in expander unit 80. Once the concrete or similar material has adequately set or cured, bars 83 are removed prior to collapsing the expander unit 80. Alternatively, liner 81 is made without any holes and a transverse interconnection opening can be made by suspending and compressing a polystyrene or similar compressible material shown as plug 85 in FIG. 16 between fully expanded cells. This alternative preferred method inhibits the seepage of watery concrete into the openings and cavities. This method is preferably used to create openings for top/bottom access holes 39, AC plug 68, light fixture 66 and light switch 63.

While embodiments of the present invention and modifications thereto have been shown and disclosed in the drawings and specification, alternate embodiments of the present invention will be apparent to a person of ordinary skill in the art and this application is intended to include those embodiments within the full breadth and scope of the claims. The present invention is not limited by any parameters described herein and the present invention need not include all of the features disclosed in the single embodiment, but rather one or more features may be included.

What is claimed is:

1. A structure including:

a plurality of side abutting, one-piece, cementitious, wall panels; each panel comprising:

a first end;

a second end spaced apart from said first end in a longitudinal direction;

a first side;

a second side spaced apart from said first side in a transverse direction;

a top;

a bottom;

a plurality of parallel cavities spanning from said first end to said second end between said top and said bottom; and one or more pathways for conduits for utilities; each said pathway spanning transversely between said cavities and between said cavities and said sides and exiting said sides at a predeterinined location so as to align with a pathway exiting an abutting wall panel;

a baseboard access comprising a plurality of baseboard openings in said top adjacent said first end and substantially travesing between said sides; said baseboard openings providing access to a plurality of said cavities and at least one said pathway such that conduits can be threaded between said parallel cavities.

2. The structure of claim 1 wherein each said panel includes:

removable cover means for covering said baseboard access.

3. The structure of claim 1 further including:

a plurality of side abutting, one-piece, cementitious, ceiling/floor panels; each ceiling/floor panel comprising:

a first end;

a second end spaced apart from said first end of said ceiling/floor panel in a longitudinal direction;

a first side;

a second side spaced apart from said first side of said ceiling/floor panel in a transverse direction;

a top;

a bottom;

a plurality of parallel cavities spanning from said first end of said ceiling/floor panel to said second end of said ceiling/floor panel between said top of said ceiling/floor panel and said bottom of said ceiling/floor panel;

a plurality of openings through said top and said bottom adjacent said first end and adjacent said second end and substantially traversing between said sides of said ceiling panel; said ceiling/floor panel openings providing access to a plurality of said ceiling/floor panel cavities for threading conduits between said parallel cavities of said ceiling/floor panel;

one or more pathways for conduits spanning transversely between said ceiling/floor panel cavities and between said cavities and said sides and exiting said sides at a predetermined location so as to align with one or more pathways exiting an abutting ceiling panel; at least one said pathway being accessible through said plurality of openings; wherein:

said plurality of ceiling/floor panels are joined top said plurality of plurality of wall panels such that a plurality of said cailing/floor panel openings align with a plurality of said wall panel parallel cavities so as to provide a pathway for conduits therebetween and access for threading conduits therebetween and transversely through said ceiling/floor panels.

* * * * *